US011626092B2

(12) United States Patent
Mori et al.

(10) Patent No.: US 11,626,092 B2
(45) Date of Patent: Apr. 11, 2023

(54) METHOD FOR CONTROLLING EFFECT APPLYING DEVICE FOR APPLYING ACOUSTIC EFFECT TO SOUND SIGNAL

(71) Applicant: YAMAHA CORPORATION, Hamamatsu (JP)

(72) Inventors: Takashi Mori, Hamamatsu (JP); Jun Toyama, Kawasaki (JP)

(73) Assignee: YAMAHA CORPORATION, Hamamatsu (JP)

( * ) Notice: Subject to any disclaimer, the term of this patent is extended or adjusted under 35 U.S.C. 154(b) by 204 days.

(21) Appl. No.: 17/231,567

(22) Filed: Apr. 15, 2021

(65) Prior Publication Data

US 2021/0233503 A1 Jul. 29, 2021

Related U.S. Application Data

(63) Continuation of application No. PCT/JP2019/040300, filed on Oct. 11, 2019.

(30) Foreign Application Priority Data

Oct. 16, 2018 (JP) ..... JP2018-194885

(51) Int. Cl.
*G10H 1/047* (2006.01)
*G10H 1/053* (2006.01)
*H04R 1/30* (2006.01)

(52) U.S. Cl.
CPC ..... *G10H 1/047* (2013.01); *G10H 1/053* (2013.01); *H04R 1/30* (2013.01); *G10H 2210/215* (2013.01)

(58) Field of Classification Search
None
See application file for complete search history.

(56) References Cited

U.S. PATENT DOCUMENTS 2,489,653 A 11/1949 Leslie
4,308,428 A * 12/1981 Finch ..... G10H 1/043 84/706

(Continued)

FOREIGN PATENT DOCUMENTS

JP 2003058159 A 2/2003
JP 2017049349 A 3/2017

OTHER PUBLICATIONS

International Search Report issued in Intl. Appln. No. PCT/JP2019/040300 dated Dec. 17, 2019. English translation provided.

(Continued)

*Primary Examiner* — Walter F Briney, III
(74) *Attorney, Agent, or Firm* — Rossi, Kimms & McDowell LLP

(57) ABSTRACT

Provided is a device 1 including: a signal processing unit 40 that applies a rotary speaker effect corresponding to a rotation speed value to a sound signal and control a tone color of the sound signal; and a control unit 10 that gradually changes, in response to a change command of the rotation speed value, the rotation speed value from a first speed to a second speed higher than the first speed with a first change curve having a first delay, and gradually changes control of the tone color from a first characteristic to a second characteristic that is stronger in the high frequency range than the first characteristic with a second change curve having a second delay shorter than the first delay.

12 Claims, 3 Drawing Sheets

(56) References Cited

U.S. PATENT DOCUMENTS

2013/0163787 A1* 6/2013 Moon ..... H03F 3/68
381/120
2017/0061945 A1* 3/2017 Okazaki ..... G10H 1/047

OTHER PUBLICATIONS

Written Opinion issued in Intl. Appln. No. PCT/JP2019/040300 dated Dec. 17, 2019.

* cited by examiner

METHOD FOR CONTROLLING EFFECT APPLYING DEVICE FOR APPLYING ACOUSTIC EFFECT TO SOUND SIGNAL

TECHNICAL FIELD

The present invention relates to a method for controlling an effect applying device for applying an acoustic effect to a sound signal, and an effect applying device.

BACKGROUND ART

As an example of a speaker capable of modulating an input sound signal and applying a special acoustic effect, a rotary speaker disclosed in Patent Literature 1 is given. The rotary speaker has a speaker horn rotationally driven by an electric motor or the like in a speaker box. For example, when the speaker horn approaches an audience through rotational driving, the frequency of sound emitted from the speaker horn gradually increases due to the Doppler effect, and the volume of the sound gradually increases. Conversely, when the speaker horn moves away from the audience, the frequency of the sound emitted from the speaker horn gradually decreases due to the Doppler effect, and the volume of the sound gradually decreases. In addition to this, a complex acoustic effect corresponding to the shape of the speaker or the horn is applied to the sound. Hereinafter, both the acoustic effect applied to the sound by the rotary speaker and the acoustic effect obtained by simulating the rotary speaker through signal processing are referred to as a "rotary speaker effect".

In general, in a rotary speaker, the rotation speed of a speaker horn can be switched between two levels, high speed and low speed, according to a user operation performed on a switch or the like. A rotary speaker is often used to apply an acoustic effect to a sound played by an electric organ, a guitar, or the like, and a user of the rotary speaker, such as a performer of an electric organ, performs while switching the rotation speed of a speaker horn through a switch operation.

CITATION LIST

Patent Literature

Patent Literature 1: Specification of U.S. Pat. No. 2,489,653

SUMMARY OF INVENTION

In recent years, various techniques for simulating the rotary speaker effect through signal processing have been proposed. Ina rotary speaker, there is a delay from when speed switching is instructed until when the rotation speed of the speaker increases, and it is desirable to also reproduce this delay from the viewpoint of reality. In the simulation of the rotary speaker effect, when the rotation speed value (the parameter corresponding to the rotation speed) is changed after being delayed due to the switch operation, no change occurs in the sound immediately after the switch operation, and thus it has been found that there is a problem in that it is difficult for the user to realize that the rotation speed has been switched. In a physical rotary speaker, immediately after performing a switch operation, the user can feel the speed switch from a change in the driving noise of an electric motor, a subtle variation of the performance sound caused by a change in the driving power of the electric motor, and the like. However, such a change and variation have not been taken into consideration in the mode of simulation realized by conventional signal processing.

The present invention has been made in view of the above-described circumstances, and provides an effect applying device for a rotary speaker effect, which enables a user to immediately feel switching of a rotation speed value when a switching operation of the rotation speed value is performed.

In order to solve the above issues, the present invention provides a control method of an effect applying device for applying a rotary speaker effect corresponding to a rotation speed value to a sound signal and controlling a tone color of the sound signal, the control method including: in response to a speed change command, gradually changing the rotation speed value from a first speed at that point in time to a second speed higher than the first speed, and changing control of the tone color from a first characteristic to a second characteristic that is different in tone color from the first characteristic, prior to the change in the rotation speed value.

In a control method according to a more preferable aspect, the second characteristic is more pronounced in the high frequency range than the first characteristic.

In the control method according to the preferable aspect, in response to the speed change command, the rotation speed value is gradually changed from the first speed to the second speed in accordance with a first change curve having a predetermined first delay.

In a control method according to a further preferable aspect, in response to the speed change command, the control of the tone color is gradually changed from the first characteristic to the second characteristic in accordance with a second change curve having a second delay shorter than the first delay.

In the control method according to the further preferable aspect, the change in the control of the tone color is synchronized with the change in the rotation speed value.

In the control method according to the further preferable aspect, the control of the tone color is performed by at least one of: (1) a filter that increases or decreases a high frequency component of a sound signal; (2) nonlinear conversion of a sound signal; (3) addition of a noise component; and (4) selection of a different sound signal.

In order to solve the above issues, the present invention provides an effect applying device including: a signal processing unit configured to apply a rotary speaker effect corresponding to a rotation speed value to a sound signal and control a tone color of the sound signal; and a control unit configured to, in response to a change command of the rotation speed value, gradually change the rotation speed value from a first speed to a second speed higher than the first speed with a first change curve having a first delay, and gradually change control of the tone color from a first characteristic to a second characteristic that is different in tone color from the first characteristic with a second change curve having a second delay shorter than the first delay.

DESCRIPTION OF EMBODIMENTS

Hereinafter, embodiments of the present invention will be described with reference to the drawings.

A: Embodiment

Figure 1:
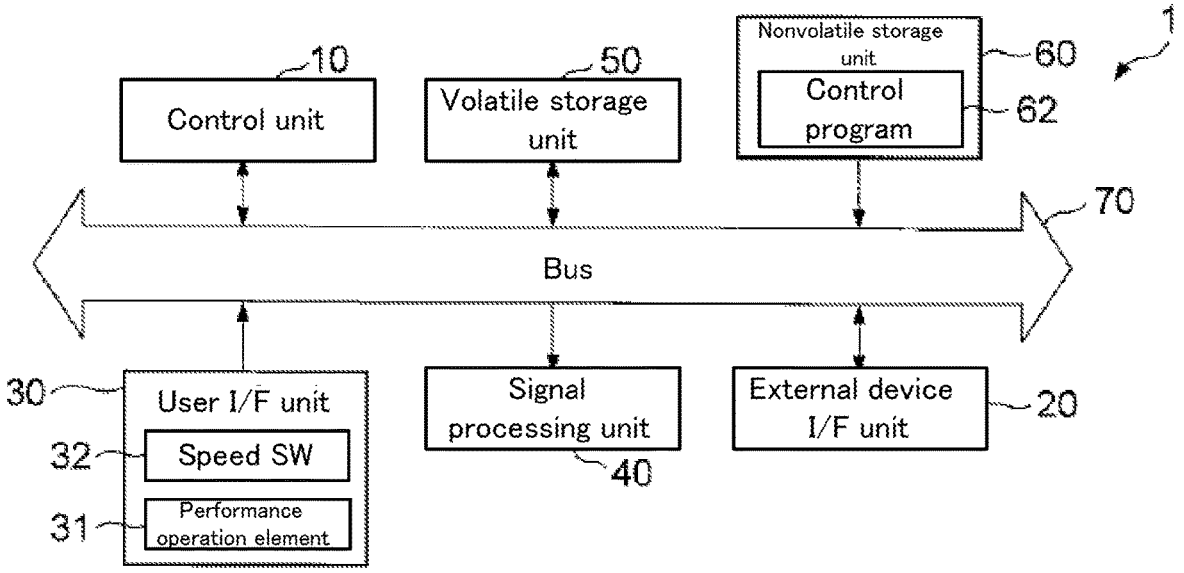
FIG. 1 is a block diagram showing an example of a hardware configuration of a device 1 according to an embodiment of the present invention.

FIG. 1 is a block diagram showing an example of a hardware configuration of a device 1 according to an embodiment of the present invention. The device 1 is an electronic musical instrument such as an electronic organ that outputs a sound signal from a sound source in accordance with a performance operation, applies a rotary speaker effect to the sound signal using an effector, and outputs the sound signal to a general speaker such as a horn speaker.

As shown in FIG. 1, the device 1 includes a control unit 10, an external device interface unit 20, a user interface unit 30, a signal processing unit 40, a volatile storage unit 50, a nonvolatile storage unit 60, and a bus 70 that mediates data exchange between these components. In FIG. 1, the "external device interface unit" is referred to as an "external device I/F unit", and the "user interface unit" is referred to as a "user I/F unit". Hereinafter, the same notations are used in this specification.

The control unit 10 is a program execution unit such as a CPU or a microcomputer. The control unit 10 functions as a control center of the device 1 by executing a control program 62 stored in the nonvolatile storage unit 60. Hereinafter, the control unit 10 operating according to the control program 62 is referred to as "control unit 10'". As shown in the functional block diagram of FIG. 2, the control unit 10' functions as a rotation speed value and gain generation unit 12 and a speaker position generation unit 14. Details of the processing executed by the control unit 10' are described below. Because the present invention relates to the control of an effect applying device that simulates a rotary speaker effect through signal processing, a parameter corresponding to the rotation speed of a physical rotary speaker is processed. Accordingly, in this specification, the parameter corresponding to the rotation speed is referred to as a "rotation speed value", in order to distinguish it from the rotation speed of the physical rotary speaker.

The external device I/F unit 20 is an aggregate of interface circuits for connecting external devices such as a sound source circuit and a speaker. Although specific illustrations are omitted in FIG. 1, the external device I/F unit 20 includes an A/D converter and a D/A converter. A sound source circuit is connected to the A/D converter of the external device I/F unit 20, and a powered speaker is connected to the D/A converter of the external device I/F unit 20. The D/A converter of the external device I/F unit 20 performs D/A conversion on a digital sound signal supplied from the signal processing unit 40, and outputs an analog sound signal resulting from the conversion to the powered speaker.

The user I/F unit 30 includes an operation element operated by the user of the device 1, and the operation content of the user with respect to the operation element is transmitted from the user I/F unit 30 to the control unit 10. The user of the device 1 refers to a performer who plays the device 1. Specific examples of the operation elements included in the user I/F unit 30 include a performance operation element 31 for the user to perform a performance operation, and a speed changeover switch 32 for the user to give an instruction to change the rotation speed value. In FIG. 1, the "speed changeover switch" is abbreviated as "speed SW", and the same notation is used hereinafter. The speed SW32 turned off "0" indicates a first speed VL, and the speed SW32 turned on "1" indicates the second speed VH, which is higher than the first speed VL. In the device 1 of the present embodiment, the ON operation of the speed SW32 performed by the user corresponds to an instruction (LH change command) to switch the rotation speed value from the first speed VL to the second speed VH, and the OFF operation corresponds to an instruction (HL change command) to switch the rotation speed value from the second speed VH to the first speed VL.

Figure 2:
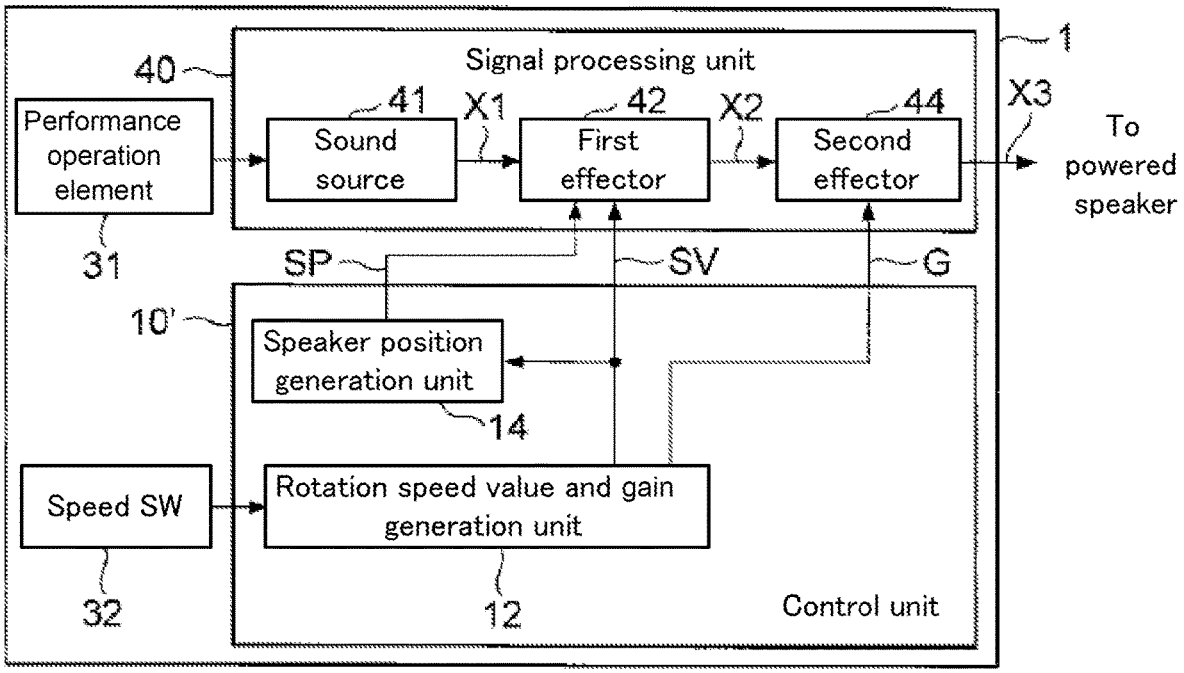
FIG. 2 is a functional block diagram showing an example of a functional configuration of the device 1.

The signal processing unit 40 is, for example, an SPU (Signal Processing Unit). As shown in FIG. 2, the signal processing unit 40 includes a sound source 41 for generating a sound signal X1, a first effector 42 for applying a rotary speaker effect, and a second effector 44 for controlling tone color. The sound source 41 generates a sound signal X1 in accordance with a user's performance operation. The first effector 42 performs, on the sound signal X1, signal processing for applying a rotary speaker effect corresponding to the rotation speed value SV at that point in time and the rotation position of the speaker (hereinafter referred to as a speaker position) SP at that point in time obtained from the rotation speed value SV up to that point in time, and outputs the sound signal X2 resulting from the processing to the second effector 44. Applying the rotary speaker effect refers to adjusting frequency characteristics, volume characteristics, reverberation characteristics, and the like of a sound signal in accordance with the rotation speed value SV and the speaker position SP by simulating sound transmission characteristics, the Doppler effect, and the like in accordance with the direction of the rotating speaker.

The second effector 44 performs, on the sound signal X2, signal processing for controlling the tone color, and outputs a sound signal X3 resulting from the processing to the D/A converter of the external device I/F unit 20. The second effector 44 of the present embodiment uses one high shelving filter in which the control band is set to a high frequency band (several k to around a dozen kHz), adjusts the signal components of that band of the sound signal X2 in accordance with the gain G instructed by the control unit 10, and executes processing for outputting the adjusted sound signal X3.

The volatile storage unit 50 is a RAM, for example. The volatile storage unit 50 is used by the control unit 10 as a work area when the control program 62 is executed. The nonvolatile storage unit 60 is a flash ROM or a hard disk, for example. The control program 62 is stored in advance in the nonvolatile storage unit 60. The control unit 10 reads the control program 62 from the nonvolatile storage unit 60 to the volatile storage unit 50, in response to power-on or the like of the device 1, and starts execution of the control program 62.

Figure 3:
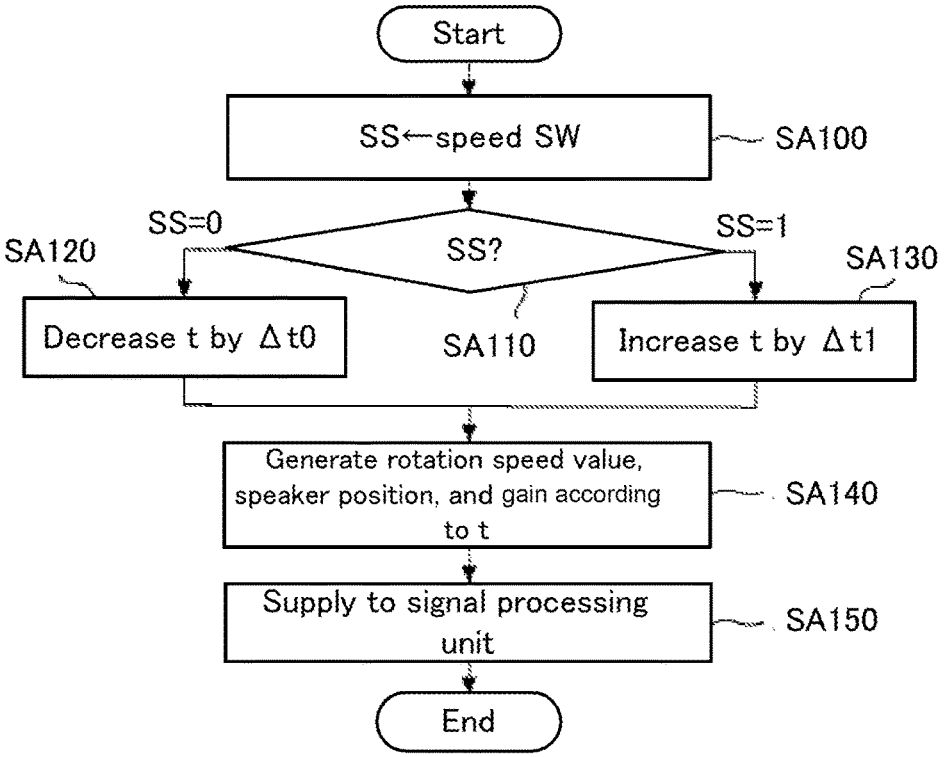
FIG. 3 is a flowchart showing a flow of a control method executed by a control unit 10 of the device 1, according to a control program 62.

The control unit 10' executes a control method that remarkably shows the characteristics of the present invention. More specifically, the control unit 10' executes the periodic processing shown in FIG. 3 at predetermined intervals. In this periodic processing, as shown in FIG. 3, the control unit 10' stores a value corresponding to the ON or OFF state of the speed SW32 in the variable SS (step SA100). In the present embodiment, when the speed SW32 is in the ON state indicating the second speed VH, the control unit 10' stores "1" as the variable SS, and when the speed SW32 is in the OFF state indicating the first speed VL, the control unit 10' stores "0" as the variable SS.

Figure 4:
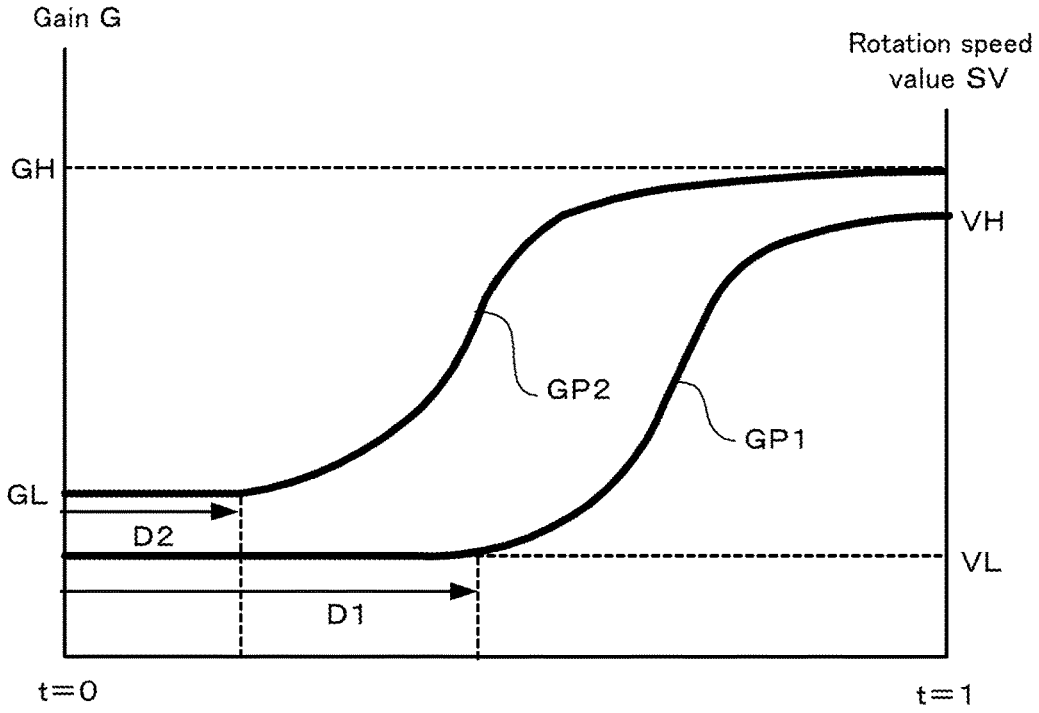
FIG. 4 is a diagram showing an example of a first change curve GP1 indicating a change in a rotation speed value and a second change curve GP2 indicating a change in a gain.

In step SA110 subsequent to step SA100, the control unit 10' determines the value of the variable SS. When it is determined that the value of the variable SS is "0" and the first speed VL is selected by the speed SW32, the control unit 10' decreases the value of the index t indicating the degree of change in the rotation speed value by Δt0 toward the minimum "0" (step SA120). The decrease in the index t stops when the value becomes "0". Conversely, when it is determined that the value of the variable SS is "1" and the second speed VH is selected, the control unit 10' increases the value of the index t toward the maximum value "1" by Δt1 (Δt0 and Δt1 are sufficiently smaller values than 1, and Δt0>Δt1) (step SA130). The increase in the index t stops when the value becomes "1". That is, the index t is a value that changes in the range of 0 to 1. For example, as shown in FIG. 4, when the speed SW32 in the OFF state is turned ON by the user (LH change command), a state in which the value of the index t is 0 corresponds to a state in which the rotation speed value before the switch is the first speed VL, and a state in which the value of the index t is 1 corresponds to a state in which the rotation speed value has changed according to the instruction and reached the second speed VH.

In step SA120 or step SA140 subsequent to step SA130, the control unit 10' calculates the rotation speed value SV of the virtual rotary speaker and the gain G for controlling the high frequency component of the sound signal according to the value of the index t calculated in step SA120 or step SA130, and further calculates the virtual speaker position SP as the integrated value of the past the rotation speed values SV. Then, in step SA150 subsequent to step SA140, the control unit 10' provides the rotation speed value SV and the speaker position SP generated in step SA140 to the first effector 42, and provides the gain G generated in step SA140 to the second effector 44.

As shown in the functional block diagram of FIG. 2, the control unit 10' functions as the rotation speed value and gain generation unit 12 and the speaker position generation unit 14. In step SA140 in FIG. 3, the generation unit 12 calculates the rotation speed value SV and the gain G, and the generation unit 14 calculates the speaker position SP based on the rotation speed value SV.

For example, when the rotation speed value is increased in response to the LH change command, the generation unit 12 calculates the rotation speed value SV that gradually changes from the first speed VL to the second speed VH, in accordance with a first change curve GP1 (see FIG. 4) having a predetermined first delay D1 and the index t at that point in time. Because the curve GP1 has the delay D1, the rotation speed value SV of the rotary speaker effect starts to increase to a degree that can be perceived by the user who has listened to the sound from the speaker, after a delay corresponding to the delay D1 from the point in time at which the LH change command was provided. As a result, a delay from the time when speed switching is instructed in the rotary speaker to the time when the rotation speed value starts to increase is reproduced. It can also be said that the first delay D1 is defined by the first change curve GP1.

In parallel with this, the generation unit 12 calculates the gain G of the high frequency component according to the index t and the second change curve GP2 (see FIG. 4) having a second delay D2 that is shorter than the delay D1. As is apparent from the curve GP2 in FIG. 4, in the device 1 of the present embodiment, the gain G gradually increases from the first gain GL to the second gain GH that is larger than the first gain GL, in response to the LH change command. It is sufficient that the enhancement of the high frequency band of the sound signal due to the increase in the gain G is small enough to give an impression of "something changed?" to the user who has listened to the sound from the speaker.

Because the curve GP2 has the delay D2, the high frequency component of the sound signal starts to increase with a delay corresponding to the delay D2 from the point in time when the LH change command is provided. Here, because the delay D2 is smaller than the delay D1, in the present embodiment, after the LH change command is provided, the tone color of the sound changes before the rotation speed value of the rotary speaker effect applied to the sound changes. The user of the device 1 can perceive that a slight change in the tone color of the sound from the speaker provides an instruction to switch the rotation speed value and the rotation speed value changes. Because the rotation speed value is switched from the low speed to the high speed mainly when invigorating a performance, it is preferable to increase the high frequency component of the sound to make the tone color splendid. It can also be said that the second delay D2 is defined by the second change curve GP2.

It is important that there is a difference in delay time between the curve GP1 and the curve GP2. The shape of the curve GP1 is preferably the shape of a change curve measured in the physical rotary speaker or a shape imitating the change curve. The shape of the curve GP2 is not so crucial, and may be the same as or different from the curve GP1. If it is desired that the switching can be clearly perceived by the user, the maximum inclination of the curve GP2 may be increased. On the other hand, if it is desired to make the switching less noticeable to the user, the maximum inclination may be reduced.

Figure 5:
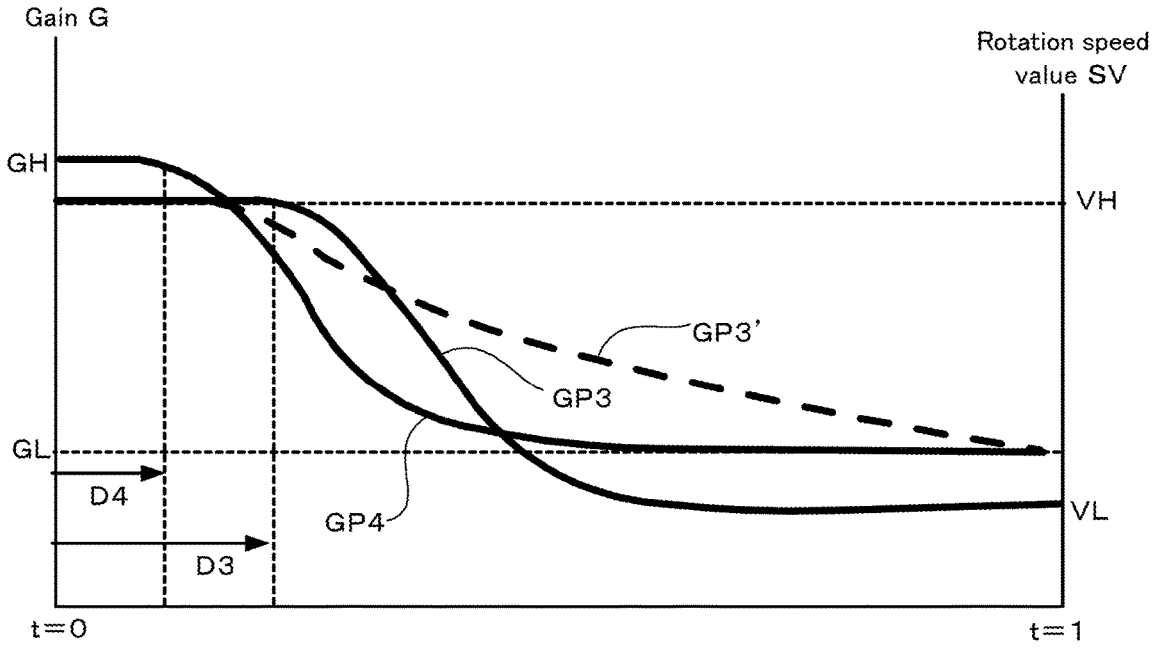
FIG. 5 is a diagram showing an example of third change curves GP3 and GP3' each indicating a change in the rotation speed value and a fourth change curve GP4 indicating a change in the gain.

In addition, in the device 1 of the present embodiment, the tone color is changed in synchronization with and prior to the change in the rotation speed value in response to the switching operation. Here, because the value of the first change curve GP1 and the value of the second change curve GP2 change in accordance with the common index t, and these two values have a correspondence relationship with each other, accordingly the change in the rotation speed and the change in the tone color are synchronized with each other. In this manner, it is possible to cause the user to perceive a change in the rotation speed value (switching from low speed to high speed) through a change in the tone color (increase in the high frequency component) without much of a delay from the switching operation. The change in tone color (increase in the high frequency component) when the rotation speed value is increased corresponds to the user's intention to enhance the performance. The basic operation is the same when the user turns off the speed SW32 and instructs switching of the rotation speed value from the second speed VH to the first speed VL (the HL change command). That is, as shown in FIG. 5, the rotation speed value SV is gradually decreased from the second speed VH to the first speed VL according to a third change curve GP3 having a third delay D3, and the gain G of the high frequency is gradually decreased from a second gain GH to a first gain GL according to a fourth change curve GP4 having a fourth delay D4 that is smaller than the third delay D3. In the physical rotary speaker, because the delay at the time of deceleration of the rotation speed value is smaller than the delay at the time of acceleration, it is preferable to set the delay D3 to a value smaller than the delay D1.

As described above, according to the device 1 of the present embodiment, it is possible to electrically simulate the rotary speaker effect while maintaining a realistic auditory sense and make the user realize that speed switching has been performed.

B: Other Embodiments

Although one embodiment of the present invention has been described above, the following embodiments are conceivable in addition to the above embodiment.

(1) Although the device 1 of the above-described embodiment is an electronic musical instrument, the device 1 may also be a single effector that includes a first effector, a second effector, and a control unit thereof and applies a rotary speaker effect to an analog sound signal from an external musical instrument such as an electric guitar, an electric organ, or a synthesizer. In this case, the effector 1 analog-to-digital converts an analog sound signal from the external musical instrument using an AD converter inside the effector 1, and obtains the digital signal X1 shown in FIG. 2. In addition, in the device 1 of the embodiment described above, first, the sound signal X1 is processed by the first effector, and the processed sound signal X2 is processed by the second effector. However, the sound signal X1 may be processed by the second effector first, and the processed sound signal X2' may be processed by the first effector.

(2) In the above embodiment, the change curves (GP1 and GP2) when the rotation speed value is switched from the first speed VL to the second speed VH and the change curves (GP3 and GP4) when the rotation speed value is switched from the second speed VH to the first speed VL have the same curve shape (delay times are different from each other). However, curves having different shapes may be used in the former case and the latter case. Specifically, in order to reduce the rotation speed value, the rotation speed value may be generated in accordance with a change curve GP3' in which the start of falling from the second speed VH is earlier than that of the first change curve GP1 and the gradual approach to the first speed VL is gentler than that of the first change curve GP1. In a physical rotary speaker, in the deceleration of the rotation speed, the rotation speed starts to decrease without delay from the point in time of the switching operation (compared with the acceleration), and it takes a long time until the rotation speed stabilizes at the speed VL. Note that the same change curve may be used for the delay of gain G, regardless of whether or not the change curve used for the delay of the rotation speed value is different. In short, any mode may be employed as long as the change in the tone color is synchronized with the change in the rotation speed value. In the above embodiment, the rotation speed value changes from the speed VL (or VH) to the speed VH (or VL) in response to the LH change command (or the HL change command). When the HL change command (or the LH change command) is received in the middle of a change, the direction of the change may be reversed at that point in time, and the speed VX at that point in time may be changed to the speed VL (or VH). In this case, the time t is set to "1" (or "0") at the time of reverse, and the change curve GP3 (or GP1) and the change curve GP4 (or GP2) may be newly prepared according to the rotation speed value and the gain G at that point in time.

(3) In the above embodiment, the control of tone color of the sound signal to which the rotary speaker effect is applied is realized by the filtering process of increasing or decreasing the high frequency component of the sound signal. However, the control of tone color of the sound signal to which the rotary speaker effect is applied may be realized by nonlinear conversion of the sound signal, addition of a noise component, or selection of a different sound signal, or may be realized by any combination of a plurality of these. Here, the nonlinear conversion is signal processing in which a sound signal is nonlinearly converted and an overtone component is added. The amount of the overtone component to be added can be controlled by changing the shape of the conversion curve. In addition of the noise component, it is preferable to generate high frequency noise having characteristics related to the sound signal and add the high frequency noise to the sound signal. In the selection of the sound signal, as the sound signal generated by the sound source 41, a sound signal having different content of a high frequency component is selected from among sound signals of the same type. In this case, because the sound control according to the gain G is performed by the sound source 41, the effector 44 is included in the sound source 41. Further, in the above embodiment, the control of the tone color is changed from the first characteristic to the second characteristic that is more pronounced in the high frequency range than the first characteristic in response to the LH change command. However, the second characteristic is not limited to a more pronounced characteristic in the high frequency range than the first characteristic, and may be a characteristic different in tone color from the first characteristic. If at least the first characteristic and the second characteristic are different in tone color, the user can perceive the difference.

(4) The rotation speed value and gain generation unit 12 and the speaker position generation unit 14 in the above embodiment are pieces of software executed by the control unit 10, but may be a hardware logic circuit or an FPGA. The signal processing unit 40 may be a DSP or an FPGA. Alternatively, the signal processing unit 40 may be configured by the CPU of the control unit 10.

(5) In the above embodiment, the control program 62 for realizing the control method according to the features of the present invention is stored in advance in the nonvolatile storage unit 60. However, the control program 62 may be distributed written in a recording medium such as a CD-ROM, or the control program 62 may be distributed via a line such as the Internet.

LIST OF REFERENCE NUMERALS

1 Device, Electronic musical instrument, Effector
10, 10' Control unit
12 Rotation speed value and gain generation unit
14 Speaker position generation unit
20 External device I/F unit
30 User I/F unit
31 Performance operation element
32 Speed SW
40 Signal processing unit
41 Sound source
42 First effector
44 Second effector
50 Volatile storage unit
60 Nonvolatile storage unit
62 Control program
70 Bus

The invention claimed is:

1. A method of controlling an effect applying device for applying a rotary speaker effect corresponding to a rotation speed value to a sound signal and controlling a tone color of the sound signal, the control method comprising:

receiving a speed change command of the rotation speed value; and in response to receiving the speed change command:

gradually changing the rotation speed value from a first speed, which is a current speed before receiving the speed change command, to a second speed higher than the first speed; and changing the tone color from a first characteristic, which is the characteristic before receiving the speed change command, to a second characteristic that is different in tone color from the first characteristic.

2. The control method according to claim 1, wherein the second characteristic is more pronounced in a high frequency range than the first characteristic.

3. The control method according to claim 1, wherein the gradually changing of the rotation speed value gradually changes the rotation speed value from the first speed to the second speed in accordance with a first change curve provided with a first delay.

4. The control method according to claim 3, wherein the changing of the tone color gradually changes the tone color from the first characteristic to the second characteristic in accordance with a second change curve provided with a second delay shorter than the first delay.

5. The control method according to claim 1, wherein the changing of the tone color is synchronized with the gradually changing of the rotation speed value.

6. The control method according to claim 1, wherein the changing of the tone color is performed by at least one of:

a filter that increases or decreases a high frequency component of a sound signal, a nonlinear conversion of a sound signal, an addition of a noise component, or a selection of a different sound signal.

7. An effect applying device comprising:

a signal processing unit configured to apply a rotary speaker effect corresponding to a rotation speed value to a sound signal and control a tone color of the sound signal; and a control unit including a processor configured to, in response to a change command of the rotation speed value: gradually change the rotation speed value from a first speed, which is a current speed before receiving the speed change command, to a second speed higher than the first speed; and change the tone color from a first characteristic, which is the characteristic before receiving the speed change command, to a second characteristic that is different in tone color from the first characteristic.

8. The effect applying device according to claim 7, wherein the gradually changing of the rotation speed gradually changes the rotation speed value of the first speed to the second speed in accordance with a first change curve provided with a first delay.

9. The effect applying device according to claim 8, wherein the changing of the tone color gradually changes from the first characteristic to the second characteristic in accordance with a second change curve provided with a second delay that is shorter than the first delay.

10. An effect applying device comprising:

a memory storing instructions; and a processor that implements the instructions to:

apply a rotary speaker effect corresponding to a rotation speed value to a sound signal and control a tone color of the sound signal; and in response to a change command of the rotation speed value:

gradually change the rotation speed value from a first speed, which is a current speed before receiving the speed change command, to a second speed higher than the first speed; and change the tone color from a first characteristic, which is the characteristic before receiving the speed change command, to a second characteristic that is different in tone color from the first characteristic.

11. The effect applying device according to claim 10, wherein the gradually changing of the rotation speed gradually changes the rotation speed value of the first speed to the second speed in accordance with a first change curve provided with a first delay.

12. The effect applying device according to claim 11, wherein the changing of the tone color gradually changes from the first characteristic to the second characteristic in accordance with a second change curve provided with a second delay that is shorter than the first delay.

* * * * *